US006881075B2

(12) United States Patent
Huang et al.

(10) Patent No.: US 6,881,075 B2
(45) Date of Patent: Apr. 19, 2005

(54) BOARD-TO-BOARD CONNECTOR

(75) Inventors: Chung-Hsin Huang, Tucheng (TW); Yung-Chi Peng, Tucheng (TW); Shu-Man Chiang, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 10/614,167

(22) Filed: Jul. 8, 2003

(65) Prior Publication Data

US 2005/0009379 A1 Jan. 13, 2005

(51) Int. Cl.[7] ..... H01R 9/09
(52) U.S. Cl. ..... 439/74; 439/660
(58) Field of Search ..... 439/65, 74, 660, 439/345, 346, 81

(56) References Cited

U.S. PATENT DOCUMENTS 5,310,357 A * 5/1994 Olson ..... 439/346
5,876,217 A * 3/1999 Ito et al. ..... 439/74
5,885,092 A * 3/1999 Ito et al. ..... 439/74
5,975,916 A * 11/1999 Okura ..... 439/74
6,623,308 B1 * 9/2003 Ono ..... 439/680
2001/0027036 A1 * 10/2001 Goto ..... 439/74

* cited by examiner

*Primary Examiner*—Hien Vu
(74) *Attorney, Agent, or Firm*—Rosenberg, Klein & Lee

(57) ABSTRACT

A board-to-board connector comprises a receptacle and a plug. The receptacle is composed of a receptacle housing and a plurality of first terminals parallelized. The plug is also composed of a plug housing and a plurality of second terminals parallelized. Meanwhile, the present invention provides a first design which forms a projection on the second terminal, a second design which defines a flange on the receptacle housing and a first wedge hole on the plug housing in accordance with the flange, and a third design which forms a retention portion and a locking portion on the first terminal and a second wedge hole on the plug housing in accordance with the locking portion, thereby avoiding terminals yield and providing a stable improved retention between the receptacle and the plug.

8 Claims, 13 Drawing Sheets

BOARD-TO-BOARD CONNECTOR

BACKGROUND OF THE INVENTION

1. Field of the Invention

The present invention general relates to a board-to-board connector, and especially to a board-to-board connector having a receptacle and a plug which is capable of assuring a reliable interlock therebetween.

2. The Related Art

In the field of the electronics industry, in order to electrical connect two parallel printed circuit boards (PCBs), it is necessary to provide a surface mount miniature board-to-board connector which is composed of a receptacle with a plurality of first contacts and a plug with a plurality of second contacts. One end of the first and second contacts engages with each other, the other end of the first and second contacts connects to a printed circuit board respectively.

At present, the trend of consumer electronics such as a mobile telephone or a digital still camera constantly reduces its size. The board-to-board connector used in the miniaturization consumer electronic devices is correspondingly required tinier and tinier. Moreover, contacts of the connectors are arranged thicker and thicker. In this consequence, however, it becomes difficult to ensure a firmly engagement between the plug and the receptacle of the board-to-board connector.

It is desirable to retain the connector components in engagement with each other and fulfill their need. A locking mechanism has been developed for such connector. U.S. Pat. No. 5,876,217, issued on Mar. 2, 1999 discloses a traditional board-to-board connector described an interlock structure of a receptacle and a plug therebetween, as shown in FIG. 14. A plurality of receptacle contacts 50 are shaped to have a straight locking member 51 and a resilient contact member 52 paralleled roughly with the locking member 51. A free end of the resilient contact member 52 extends inwardly to form a contact end 53 which engages with a resilient arm 61 of a plurality of plug contacts 60.

In the above-mentioned board-to-board connector, an interlock between the receptacle and the plug is achieved through the locking member 51 engaging with a locking recess 71 formed on a plug body 70. When the plug inserts into the receptacle, the plug body 70 slides into a channel formed between the resilient contact member 52 and the locking member 51 along a substantial vertical direction. In the process of the plug body 70 pressed contacting the locking member 51, a moment arm of the pressed contact torque is so short because of a straight design of the locking member 51. Therefore, it is necessary to act a large force on the locking member 51 to accomplish the foregoing insertion process. As a result, the locking member 51 may be broken or yielded due to a large stress resulted from the large force, further it can't realize a stable interlock between the receptacle and the plug.

SUMMARY OF THE INVENTION

Thus, a first objective of the present invention is to provide a board-to-board connector which comprises a receptacle and a plug. A stable interlock between the receptacle and the plug can be achieved and a terminal yield failure can be avoid through a pressed contact between a projection of a second terminal and a contact end of a first terminal.

A second objective of the present invention is to provide a board-to-board connector which comprises a receptacle and a plug. A stable interlock between the receptacle and the plug can be achieved and a terminal yield failure can be avoid through an engagement of a flange formed on a receptacle housing and a first wedge hole of a plug housing.

A third objective of the present invention is to provide a board-to-board connector which comprises a receptacle and a plug. A stable interlock between the receptacle and the plug can be achieved and a terminal yield failure can be avoid through an interlock of a locking portion arranged horizontally of a first terminal and a second wedge hole formed on a plug housing.

To attain the first object, the present invention provides a board-to-board connector comprising a receptacle and a plug. The receptacle includes a receptacle housing mounting a plurality of first terminals in two parallel arrays. The receptacle housing has a flat base, and opposite sides of the flat base form a plurality of fist slots for holding the first terminals. Side walls are projected vertically from edges of the flat base. A projected portion extends upwardly from a middle portion of the flat base to define a lodged channel with the side walls therebetween. The projected portion forms a plurality of mounting holes in accordance with the first slots. Each first terminal has a first base portion, a first solder tail portion extending outwardly from one end of the first base portion for connection with a first printed circuit board, and a first spring contact portion bent upwardly from the other end of the first base portion and received in the mounting hole.

The plug includes a plug housing mounting a plurality of second terminals in two parallel arrays. The plug housing has a bottom board, and opposite sides of the bottom board forming a plurality of second slots for holding the second terminals. Lateral boards extend upwardly from a rim of the bottom board to define a recess therein. A plurality of lodged holes extend through the lateral bards in accordance with the second slots. Each second terminal has a second base portion, a second solder tail portion extending outwardly from one end of the second base portion for connection with a second printed circuit board, a second spring contact portion bent upwardly from the other end of the second base portion fitted in the lodged hole, and a projection formed on the second spring contact portion and extending away from the second base portion.

When the receptacle and the plug are in assembled condition, the lateral boards slide into the lodged channel, the projected portion inserts into the recess, the first spring contact portion pressed contacts the projection. Thereby a stable retention and interlock between the receptacle and the plug of the present invention can be achieved.

To attain the second object, the board-to-board connector of the present invention further provides a flange on inner surfaces of the side walls of the receptacle extending toward the lodged channel. The plug is shaped to have a first wedge hole formed on outer surface of the lateral boards thereof in according to the flange. When the plug inserts into the receptacle, the lateral boards slide into the lodged channel, the projected portion lodges in the recess. Thereby a horizontal relative movement of the receptacle and the plug is restricted. Simultaneously, the flange inserts into the first wedge hole to maintain the receptacle and plug fixed together thereby to prevent the receptacle and plug from a vertical relative movement. Thus, the board-to-board connector of the present invention achieves a stable interlock between the receptacle and the plug via an engagement of the receptacle housing and the plug housing, owing to the first and second terminal only have a small contact pressure therebetween. It is not necessary to provide an interlock force to interlock therebetween, so a stress acted on the terminal can be decrease and a terminal yield failure can be avoid.

To attain the third object, the first terminal of the present invention is provided with a retention portion extending upwardly from the first base portion and a locking portion formed on the retention portion extending parallel with the first base portion toward the first spring contact portion. The side walls define a plurality of receiving holes to receiving the retention portion. A partial portion of the side walls which is located between the lodged channel and each of the receiving holes is cut off to form a mounting channel which communicates with the lodged channel, the first slot, and the receiving hole respectively. The lateral boards of the plug form a plurality of second wedge holes on its outer surface in accordance with the second slots. When the plug inserts into the receptacle of the board-to-board connector, the lateral boards slide into the lodged channel, the projected portion lodges in the recess. Thereby, a horizontal relative movement of the receptacle and the plug is restricted. Simultaneously, the locking portion comes into the mounting holes and inserts into the second wedge holes to maintain the receptacle and the plug fixed together thereby to prevent the receptacle and the plug from a vertical relative movement. Thus, the board-to-board connector of the present invention achieves a stable interlock between the receptacle and the plug via an engagement of the first terminal and the plug housing. A shorter moment arm of a pressed contact torque can be achieved for the first terminal due to arranging the locking portion horizontally, thereby a terminal yield failure can be avoid.

BRIEF DESCRIPTION OF THE DRAWINGS

A detailed explanation of the present invention will be given, with reference to the attached drawings, for better understanding thereof to those skilled in the drawings.

DETAILED DESCRIPTION OF THE BEST MODE FOR CARRYING OUT THE PRESENT INVENTION

Figure 1:
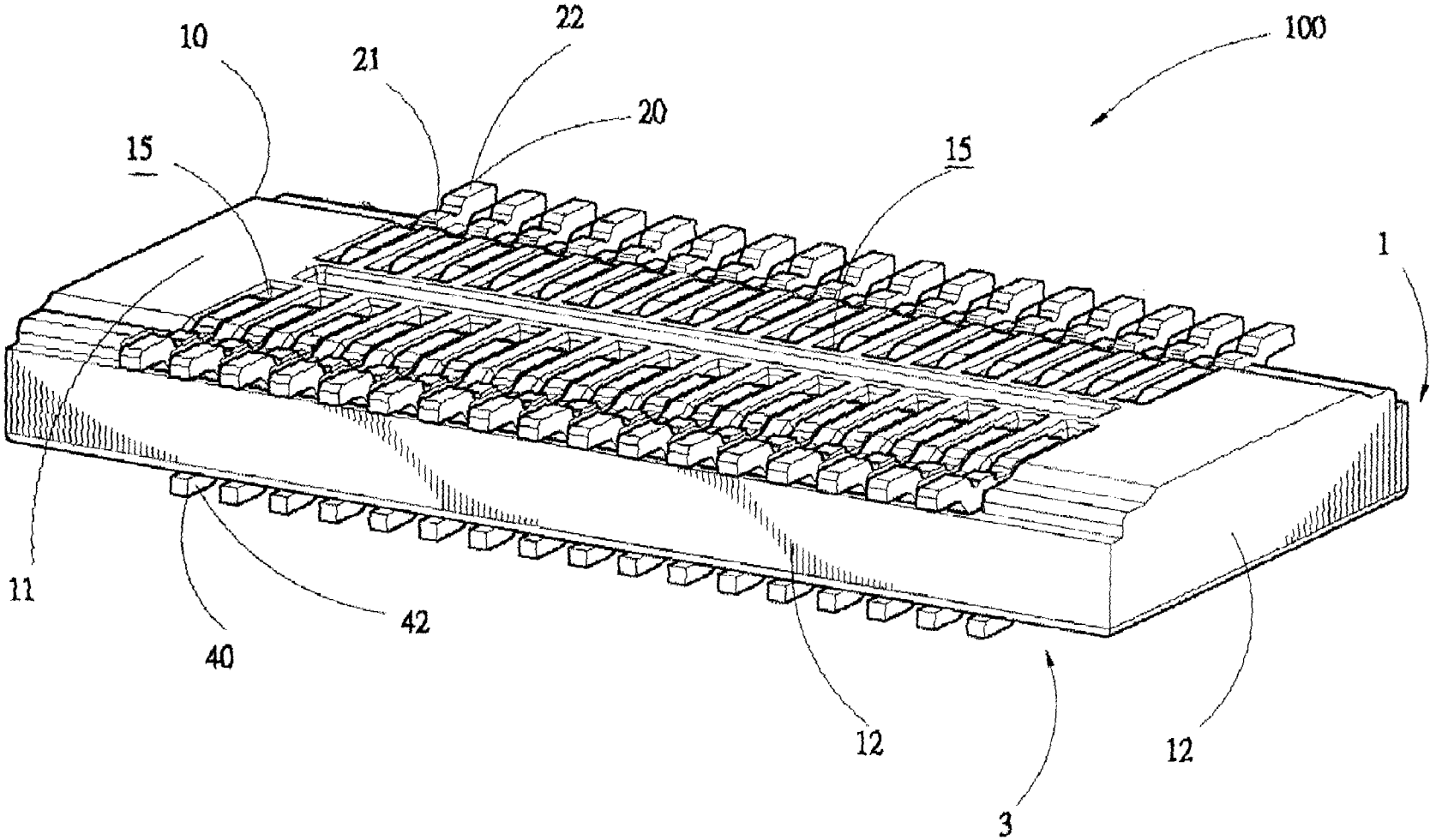
FIG. 1 is a perspective view of a board-to-board connector in accordance with the first embodiment of the present invention.
Figure 2:
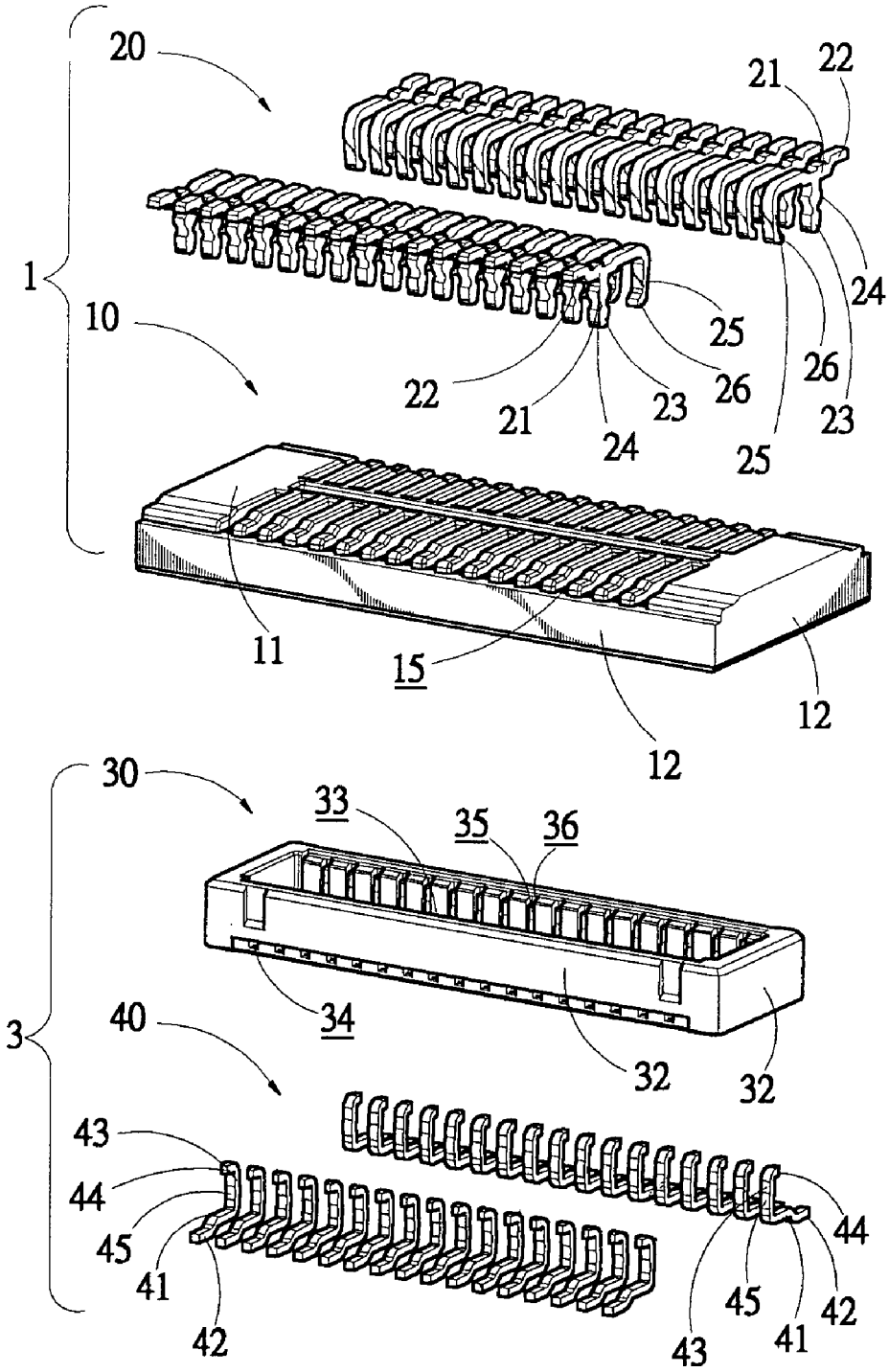
FIG. 2 is an exploded view of the board-to-board connector shown in FIG. 1.
Figure 3:
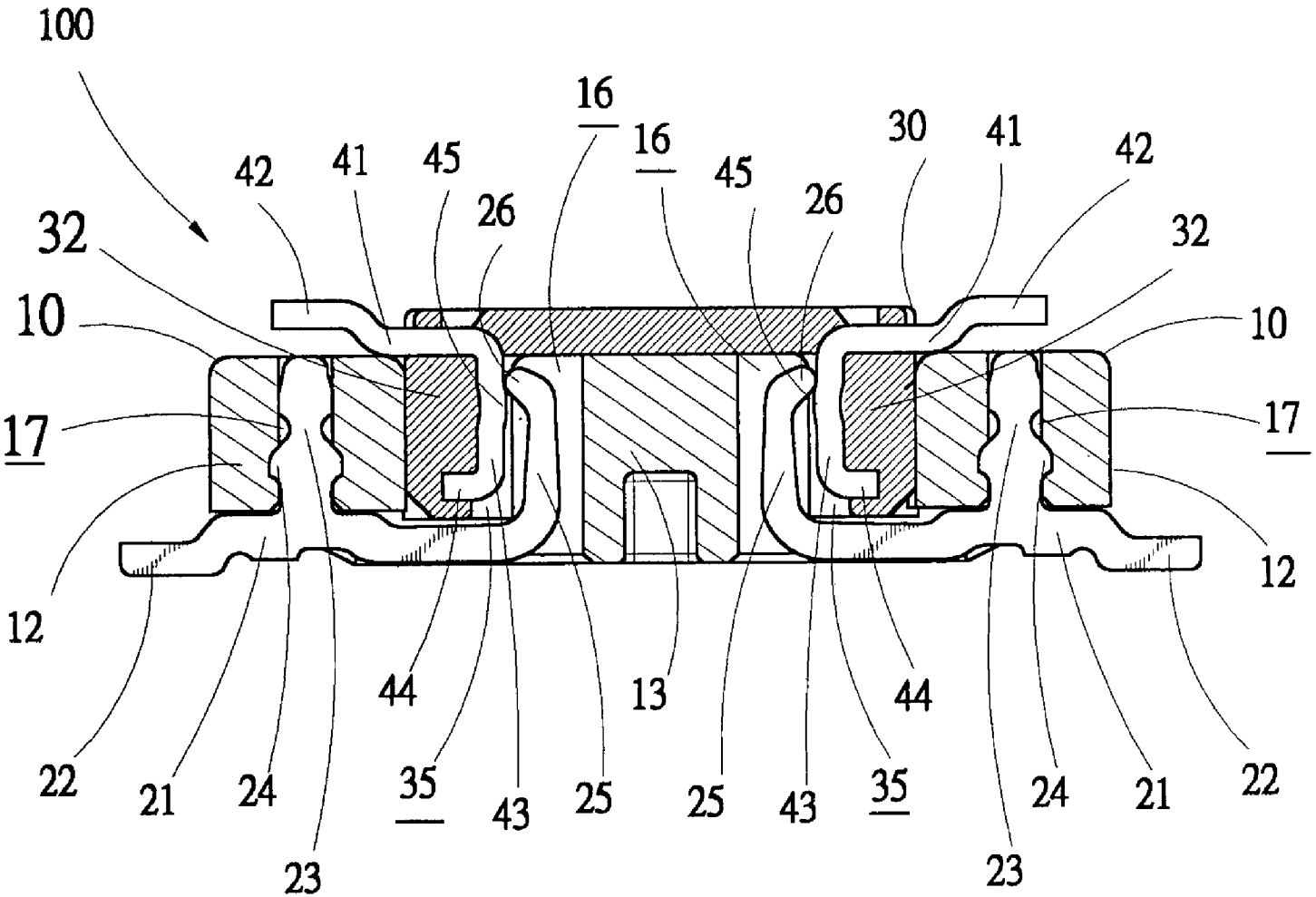
FIG. 3 is a sectional view of the board-to-board connector shown in FIG. 1.

As shown in FIG. 1 to FIG. 3, a board-to-board connector in accordance with the first embodiment of the present invention is shown. The board-to-board connector generally designed with reference numeral 100 comprises a receptacle 1 and a plug 3 which are respectively of flat configurations for surface mounting on individual printed circuit boards (PCBs)(not shown) to interconnect circuits on the boards.

Figure 4:
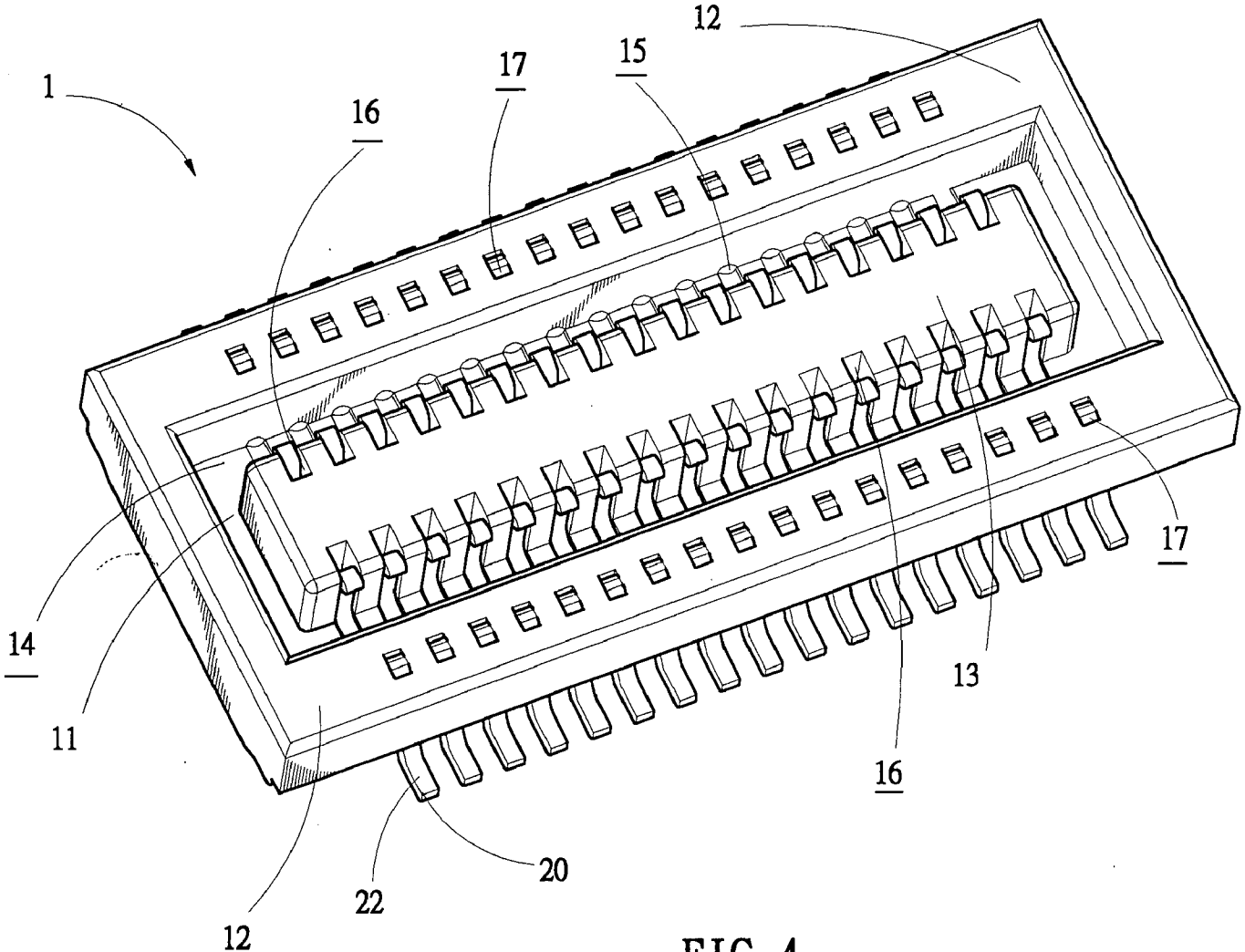
FIG. 4 is a perspective view of a receptacle utilized in the board-to-board connector shown in FIG. 1.
Figure 5:
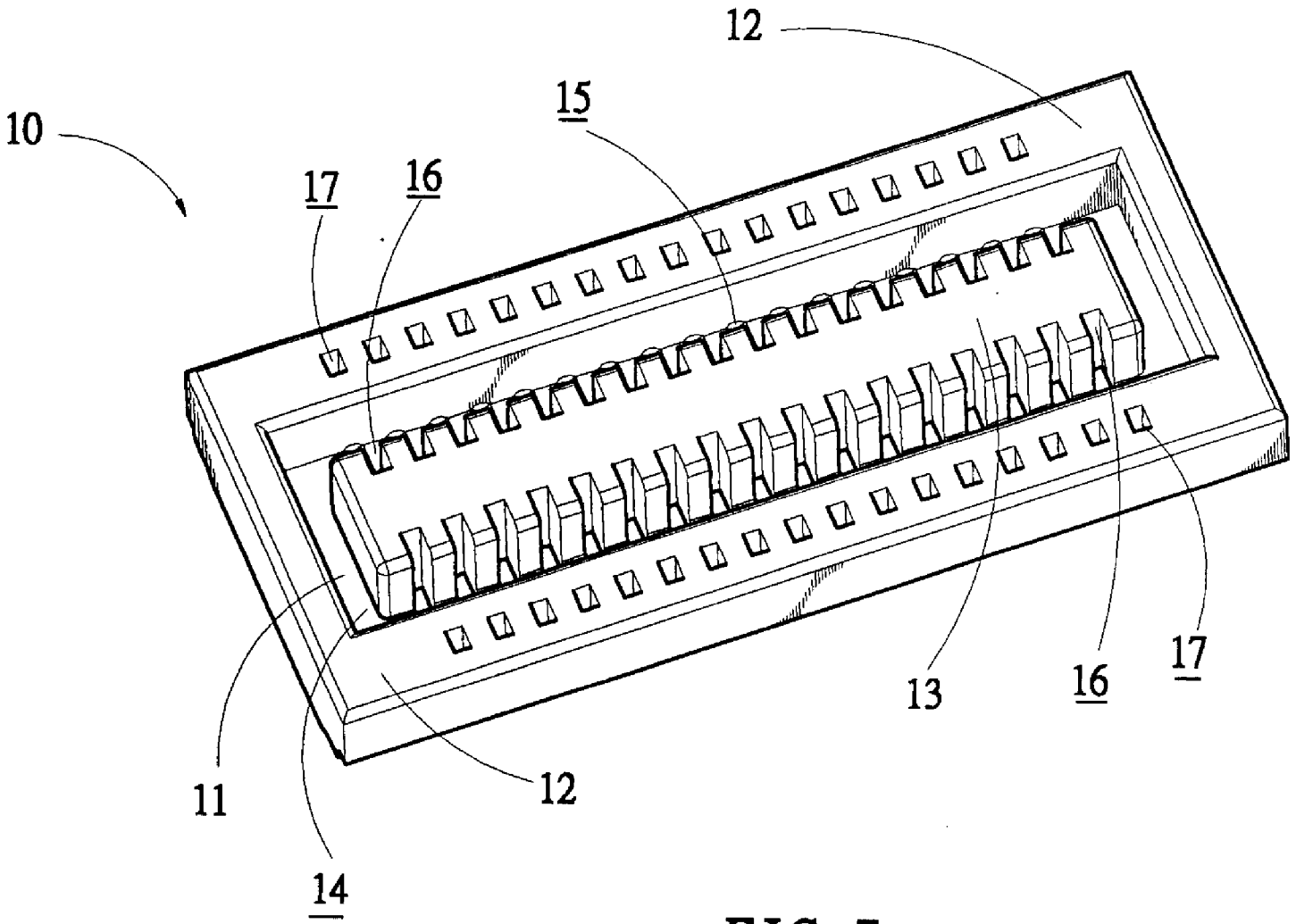
FIG. 5 is a perspective view of a receptacle housing utilized in the board-to-board connector shown in FIG. 1.

With reference to FIGS. 4 and 5, the receptacle 1 includes a receptacle housing 10 receiving a plurality of first terminals 20 in two parallel arrays. The receptacle housing 10 is of a flat rectangular configuration to have a flat base 11. Side walls 12 are projected vertically from edges of the flat base 11. A projected portion 13 extends upwardly from a middle portion of the flat base 11 to define a lodged channel 14 with the side walls 12 therebetween. Opposite sides of the flat base 11 form a plurality of evenly spaced fist slots 15 which extend outwardly through the flat base 11 for holding the first terminals 20 respectively and communicate with the lodged channel 14. The projected portion 13 forms a plurality of vertical mounting holes 16 extending therethrough and communicating with the lodged channel 14 and the first slots 15 in accordance with the first terminals 20. The side walls 12 further define a plurality of vertical receiving holes 17 extending therethrough and communicating with the first slots 15.

Figure 6:
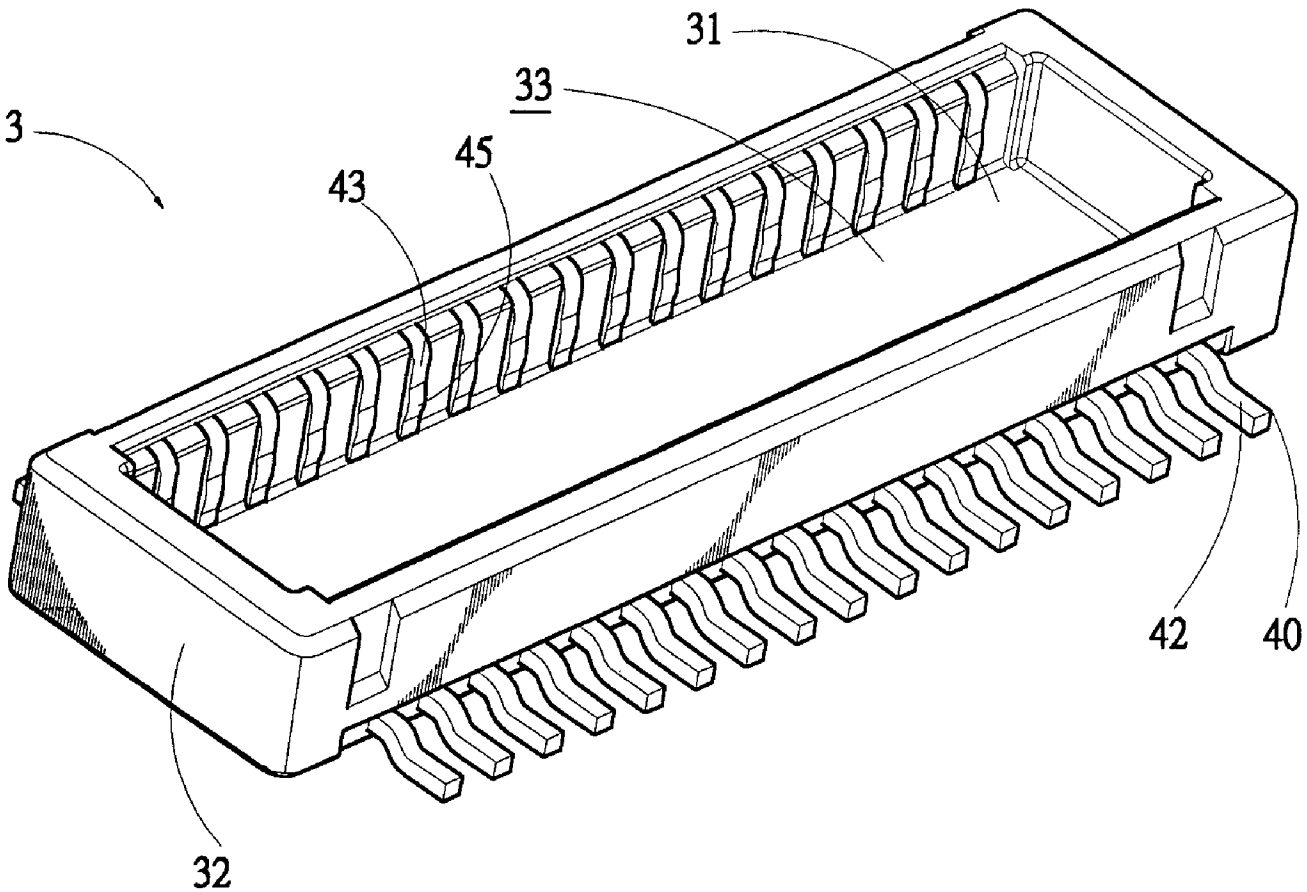
FIG. 6 is a perspective view of a plug utilized in the board-to-board connector shown in FIG. 1.
Figure 7:
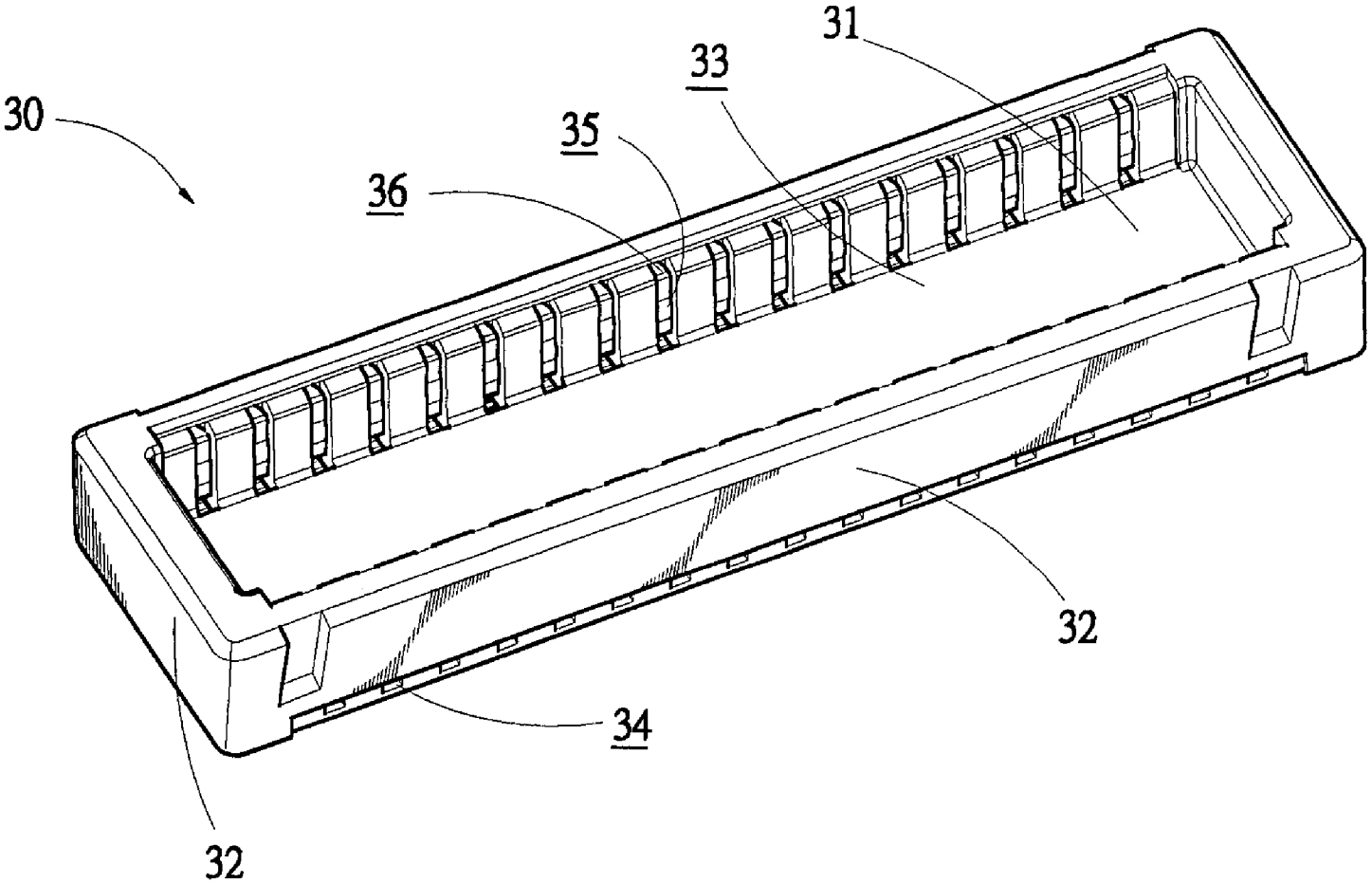
FIG. 7 is a perspective view of a plug housing utilized in the board-to-board connector shown in FIG. 1.

Referring now to FIG. 6 and FIG. 7, the plug 3 comprises a plug housing 30 receiving a plurality of second terminals 40 in two parallel arrays. The plug housing 30 is shaped a flat rectangular configuration with a flat bottom board 31 and lateral boards 32 extending upwardly from a rim of the bottom board 31 to define a recess 33 therein. The bottom board 31 is formed in its opposite sides respectively with a plurality of evenly spaced second slots 34 to communicate with outside and the recess 33. Opposite inner surfaces of the lateral boards 32 define a plurality of engaging holes 36. The engaging holes 36 are formed on an upper portion of the lateral boards 32 in accordance with the second slots 34 and a plurality of lodged holes 35, extend perpendicularly through the lateral boards 32, and communicating with the engaging holes 36, the recess 33 and the second slots 34 respectively.

Figure 8:
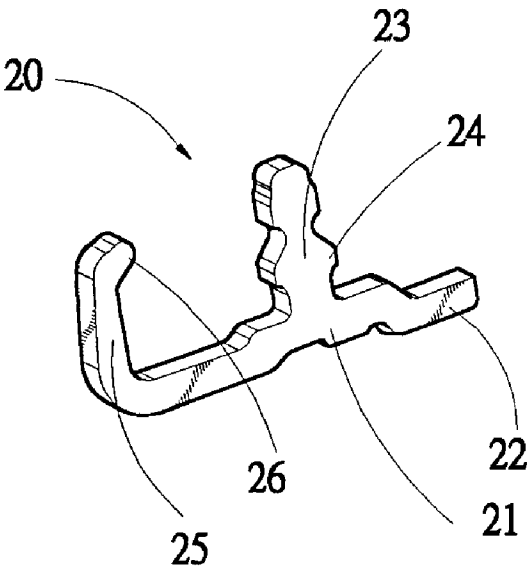
FIG. 8 is a perspective view of a first terminal utilized in the board-to-board connector shown in FIG. 1.

With reference to FIG. 8, the first terminal 20 is formed metal blanks in a known manner, such as by stamping and forming. Each first terminal 20 has a rigid horizontal first base portion 21, a horizontal first solder tail portion 22 extending from one end of the first base portion 21, a retention portion 23 extending upwardly from the first base portion 21 which a pair of barbs 24 are provided on opposite edges thereof, and a first spring contact portion 25 bent from the other end of the first base portion 21 and extending parallel with the retention portion 23. A free end of the first spring contact portion 25 is bent inwardly to define a contact end 26 which a bend angle is less than 90 degree. Compared with the foregoing prior art, a contact plane of pressed contact between the contact end 26 and the second terminal 40 has a higher attitude than a contact plant in prior art. Once the first terminal 20 has a perpendicular movement relatively to the second terminal 40 due to shaking or shifting, a more stable retention and interlock therebetween is provided than in the prior art, because of an increase of contact distance via the above design of the contact end 26.

Figure 9:
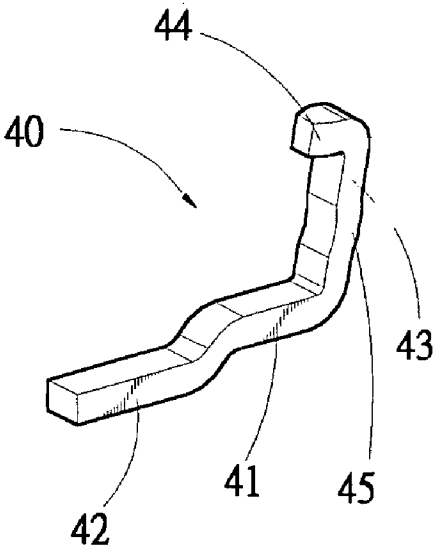
FIG. 9 is a perspective view of a second terminal utilized in the board-to-board connector shown in FIG. 1.

As shown in FIG. 9, the second terminal 40 are also formed from metal blanks by stamping and forming. The second terminal 40 has a second rigid horizontal base portion 41, a second horizontal solder tail portion 42 extending from one end of the second base portion 41, a second spring contact portion 43 bent upwardly from the other end of the second base portion 41, a contact head 44 bent vertically from a free end of the second spring contact portion 43 and a projection 45 which has an arc surface protruding from a substrate middle portion of the second spring contact portion 43 away from the second base portion 41.

With reference to FIG. 4, the first terminal 20 inserts into the corresponding first slot 15, simultaneously, the retention portion 23 comes into the received hole 17. The first spring contact portion 25 is received in mounting hole 16, and the barbs 24 of the retention portion 23 are pressed abutment against an inner wall of the received hole 17. Then with reference to FIG. 6, the second terminal 40 is pressed in the corresponding second slot 34 with the second spring contact portion 43 fitted in the lodged hole 35, and the contact head 44 inserts into the engaging hole 36 fixed thereof.

Together referring to FIGS. 1 to 3, as assembling, external surfaces of the lateral boards 32 of the plug 3 slide into the lodged channel 14 of the receptacle 1 along internal surfaces of the side walls 12 with the projected portion 13 inserted into the recess 33 simultaneously. The first spring contact portion 25 of the first terminal 20 pressed contacts the contact end 43 of the second terminal 40, and the contact end 26 of the first terminal 20 fastens the projection 45 of the second terminal 40 meanwhile.

In order to detail the stable retention and interlock of the present invention, a terminal stress analysis is provided below which gives some test dates to show a remarkable improvement compared with the prior art, U.S. Pat. No. 5,876,217. On the test course, the test plug and receptacle contacts material is Brass and Nippon Phosphor Bronze respectively, and the test receptacle contact further plates with Nippon.

At first, the traditional board-to-board connector in accordance with the U.S. Pat. No. 5,876,217 is test. When the plug engages with the receptacle, the resilient contact member 52 of the receptacle contact 50 pressed contacts the resilient arm 61 of the plug contacts 60, the locking member 51 pressed contacts the lock recess 71 of the plug body 70. The test dates can be achieved as described following: the maximum normal force acted on the plug contacts 60 is 0.54N, the maximum stress acted on a head of the locking member 51 is 799 Mpa, a horizontal deformation displacement of the locking member 51 is 0.04 mm. Then, if the plug inserts into the receptacle completely, the test dates are below: the maximum stress acted on an external root of the locking member 51 is 727 Mpa, and the maximum normal force acted on the plug contact 60 is still 0.54N.

The next test objection is the board-to-board connector 100 in accordance with the first embodiment of the present invention. At the beginning of the first terminal 20 engaging with the second terminal 40, the maximum normal force of the second contact portion 43 acted by the contact end 26 of the first terminal 20 is 0.69N, the maximum stress acted on a inner arc surface formed on a common boundary of the first base portion 21 and the first spring contact portion 24 is 748 Mpa which is lower than 799 Mpa of the U.S. Pat. No. 5,876,217. When the first and the second terminal 20,40 maintain a steady engagement, the maximum normal force acted on the second contact portion 43 is 0.49N, and the maximum stress acted on both edges inner arc surface formed on a horizontal extending portion of the first base portion 21 between the locking portion 23 and the first spring contact portion 24 is 535 Mpa.

Further analyses are detailed below. Because the projection 45 of the first terminal 20 is shaped with a cylinder-type surface and each side of the projection 45 has a flat configuration, the test dates of the maximum normal force on the inserting process is same as the pulling process. It can be achieved from the above test result that an increase of the maximum normal force from 0.49N to 0.69N on the pulling course, which generates a corresponding friction increase between the first and the second contact 20 40, further causes a hard pull in accordance with the present invention. Thereby the plug 3 can be locked fixedly with the receptacle 1 via the friction increase, and a stable retention and interlock between the receptacle 1 and the plug 3 of the present invention can be achieved.

According to the above test result, the locking member 51 of the receptacle contact 50 in U.S. Pat. No. 5,876,217 is easy to yield acted by the maximum formal force in the inserting process, and the interlock between the plug and the receptacle will be useless after the first time mating. Comparing with the U.S. Pat. No. 5,876,217, the board-to-board connector 100 of the present invention has an obvious improvement which the maximum normal force and stress are decreased 6.4% and 26.4% respectively. Thus a yield failure can be avoid through the present invention.

Figure 10:
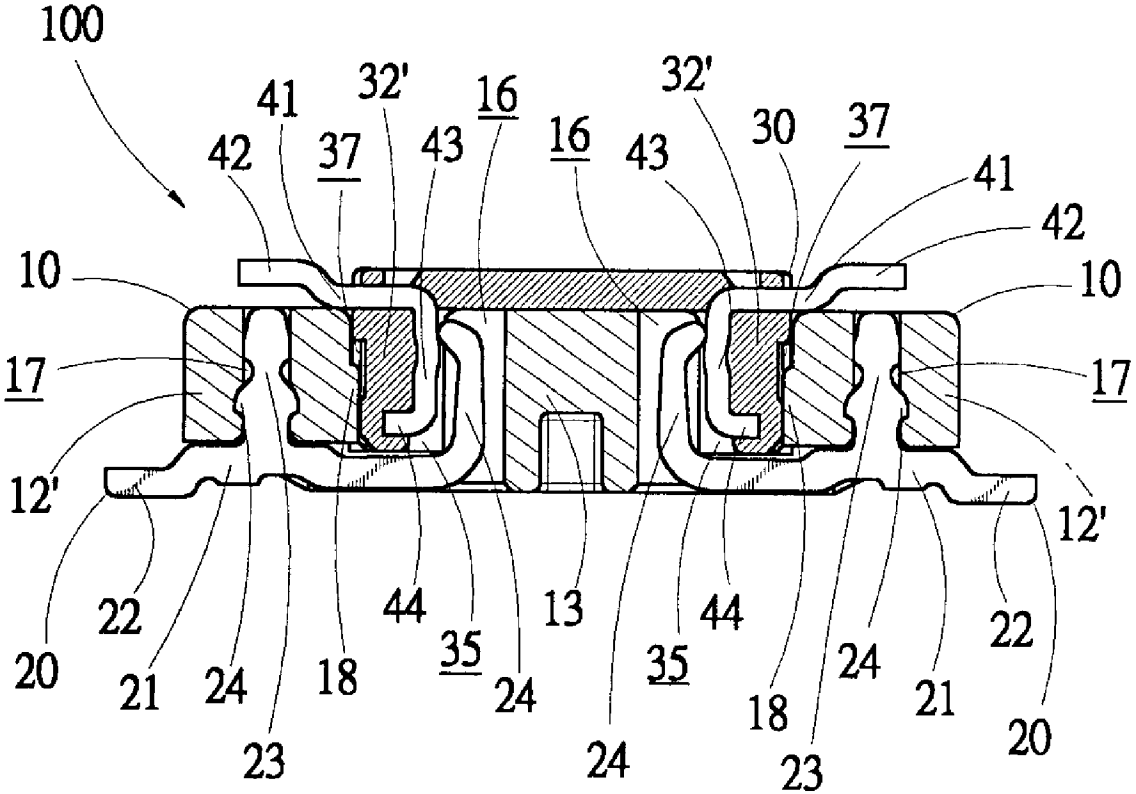
FIG. 10 is a sectional view of a board-to-board connector in accordance with the second embodiment of the present invention.
Figure 11:
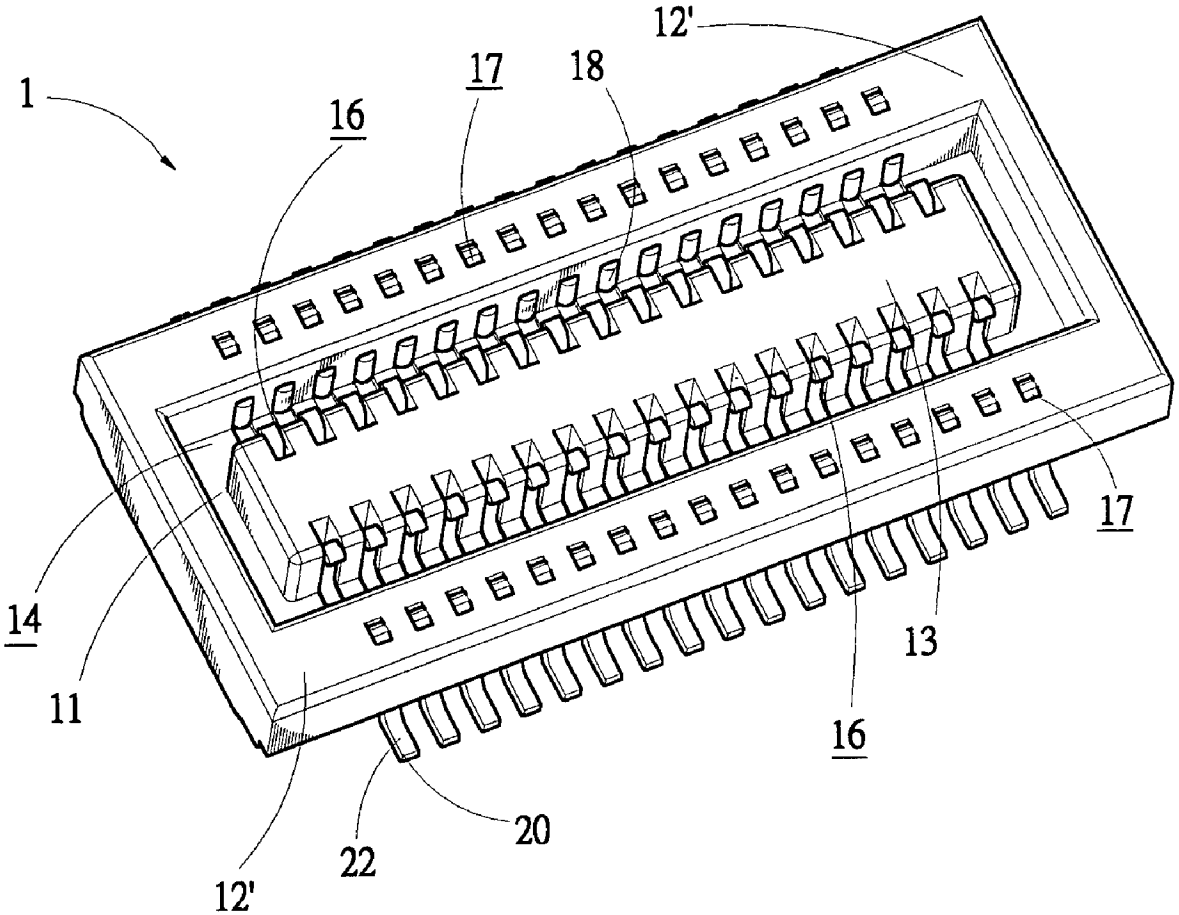
FIG. 11 is a perspective view of a receptacle housing utilized in the board-to-board connector shown in FIG. 10.
Figure 12:
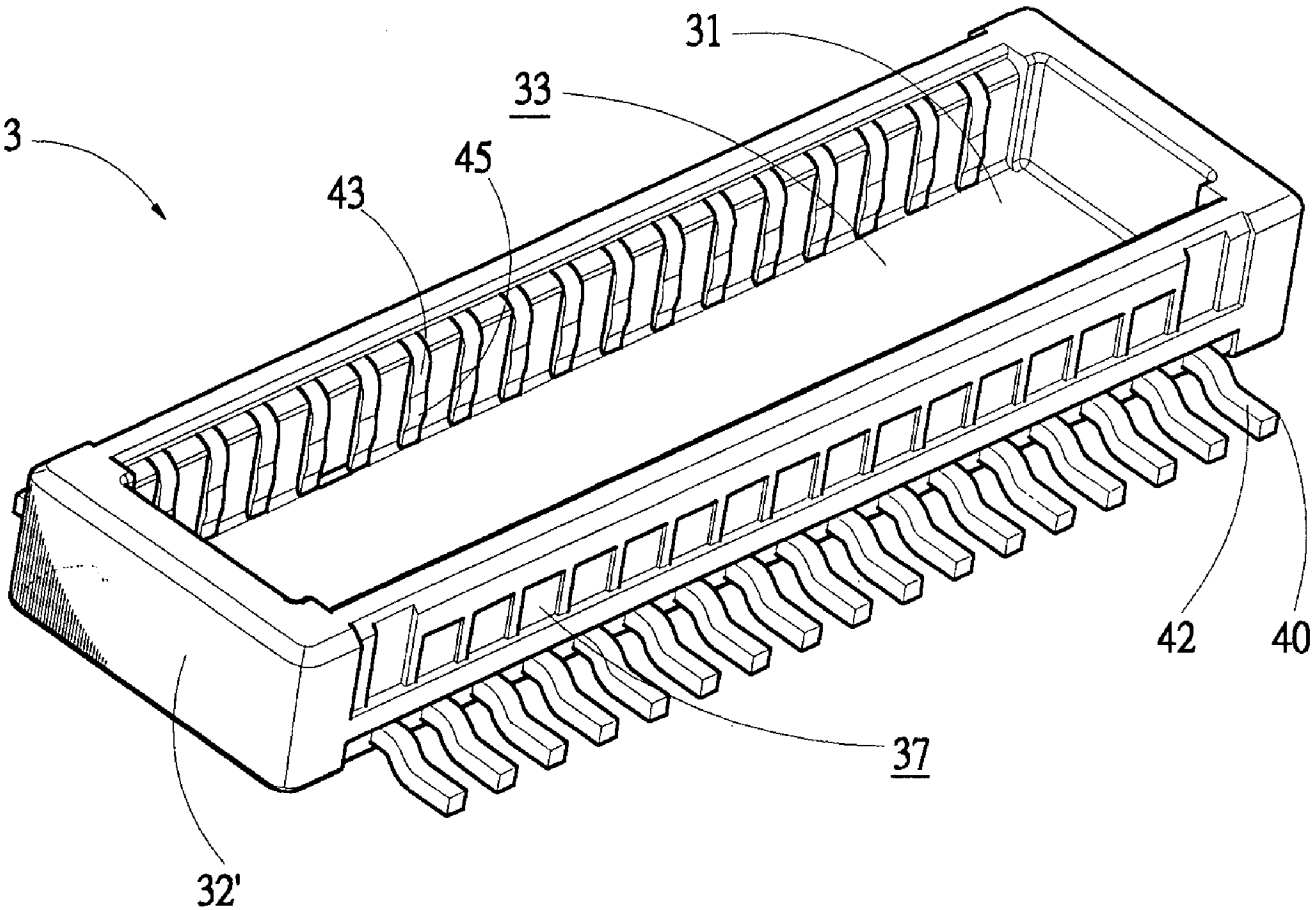
FIG. 12 is a perspective view of a plug housing utilized in the board-to-board connector shown in FIG. 10.

Referring now to FIGS. 10 to 12, a second embodiment of the present invention is described. The receptacle 1 is further provided with a plurality of flanges 18 on inner surfaces of the side walls 12' extending toward the lodged channel 14. The plug 3 is shaped to have a plurality of first wedge holes 37 formed on outer surfaces of the lateral board 32' thereof in accordance with the flanges 18.

When the plug 3 inserts into the receptacle 1 of the board-to-board connector 100 of the second embodiment, the lateral boards 32' slide into the lodged channel 14, the projected portion 13 lodges in the recess 33, thereby a horizontal relative movement of the receptacle 1 and the plug 3 is restricted. Simultaneously, each of the flanges 18 correspondingly wedges into each of the first wedge hole 37 to maintain the receptacle 1 and the plug 3 fixed together, thereby to prevent the receptacle 1 and the plug 3 from a vertical relative movement. Thus the board-to-board connector 100 of the second embodiment of the present invention achieves a stable interlock between the receptacle 1 and the plug 3 via an engagement of the receptacle housing 10 and the plug housing 30. Owing to the first and second terminal 20,40 only have a small contact pressure therebetween, it is not necessary to provide an interlock force to interlock therebetween, and the stress acted on the terminal can be decrease and the terminal yield failure can be avoid.

Figure 13:
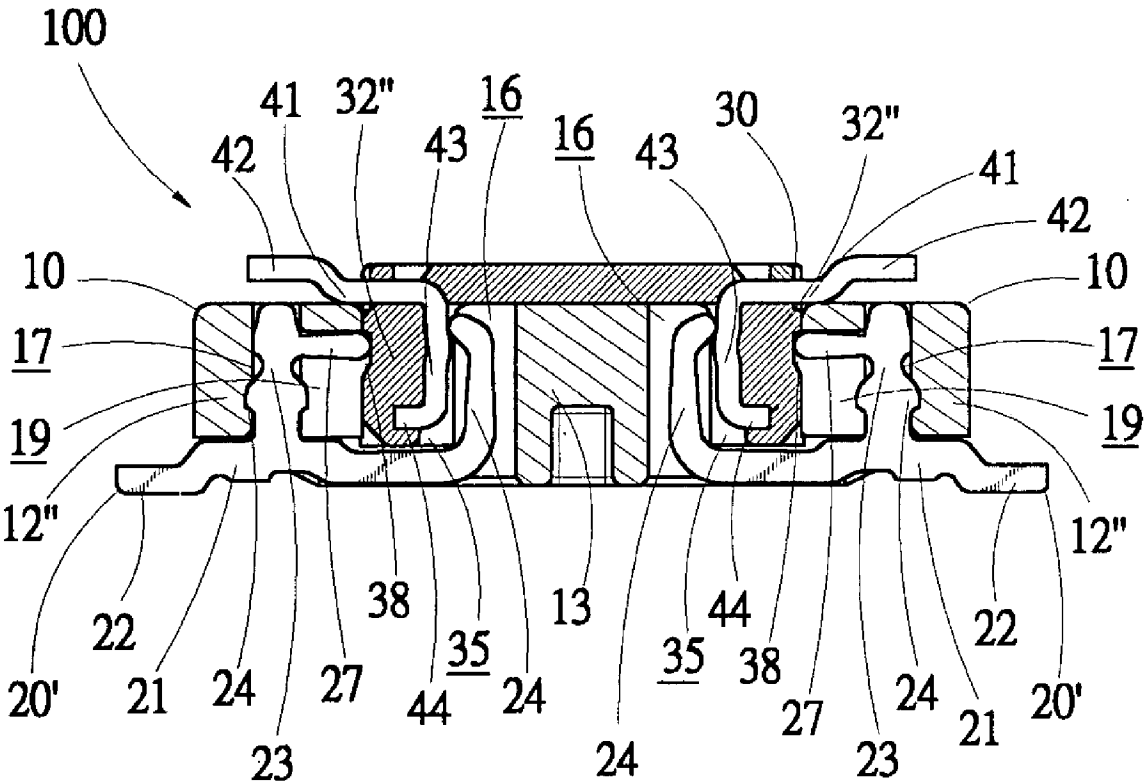
FIG. 13 is a sectional view of a board-to-board connector in accordance with the third embodiment of the present invention.
Figure 14:
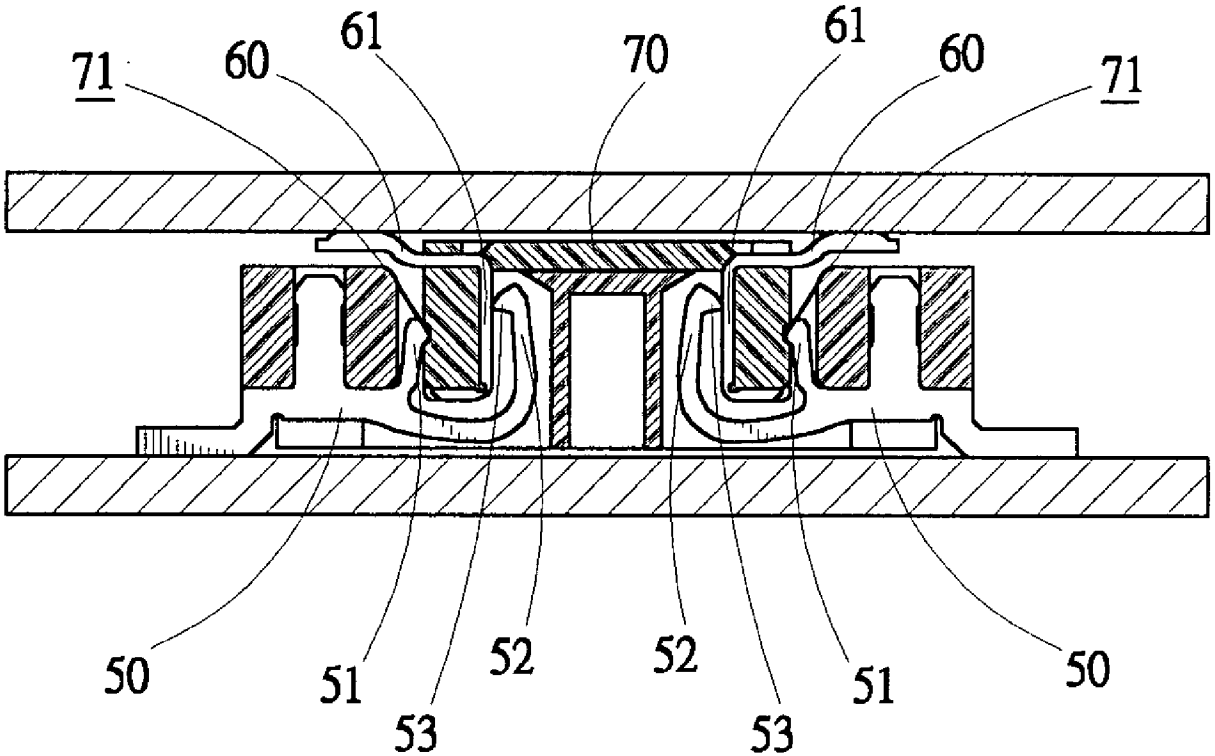
FIG. 14 PRIOR ART
FIG. 14 is a sectional view of a traditional board-to-board connector.

Referring now to FIG. 13, a third embodiment of the present invention is shown. The retention portion 23 of the first terminal 20' is provided additionally with a locking portion 27 extending parallel with the first base portion 21 toward the first spring contact terminal 25. A partial portion of the side walls 12" located between the lodged channel 14. Each of the receiving holes 17 is cut off to form a mounting groove 19 which communicates with the lodged channel 14, the first slot 15, and the receiving hole 17 respectively. The lateral boards 32" of the plug 3 form a plurality of second wedge holes 38 on its outer surface in accordance with the second slots 34.

When the plug 3 inserts into the receptacle 1 of the board-to-board connector 100 of the third embodiment, the lateral boards 32" slide into the lodged channel 14, the projected portion 13 lodges in the recess 33, thereby a horizontal relative movement of the receptacle 1 and the plug 3 is restricted. Simultaneously, the locking portion 27 comes into the mounting groove 19 and wedges into the second wedge holes 37 to maintain the receptacle 1 and the plug 3 fixed together in order to prevent the receptacle 1 and the plug 3 from a vertical relative movement. Thus the board-to-board connector 100 of the third embodiment of the present invention achieves a stable interlock between the receptacle 1 and the plug 3 via an engagement of the first terminal 20' and the plug housing 30. A shorter moment arm of a pressed contact torque, which is acted by the plug 3 on the engagement process, can be achieved for the first terminal 20 because of arranging the locking portion 27 horizontally, thereby a terminal yield failure can be avoid.

While the present invention has been described with reference to a specific embodiment thereof, the description is illustrative and is not to be construed as limiting the invention. Various modifications to the present invention may be made to the preferred embodiment by those skilled in the art without departing from the true spirit and scope of the invention as defined by the appended claims.

What is claimed is:

1. A board-to-board connector comprising:

a receptacle including a receptacle housing reveiving a plurality of first terminals in two parallel arrays, the receptacle housing having a flat base, opposite sides of the flat base forming a plurality of fist slots for holding the first terminals, side walls projected vertically from edges of the flat base, a projected portion extending upwardly from a middle portion of the flat base to define a lodged channel with the side walls therebetween, the projected portion forming a plurality of mounting holes in accordance with the first slots, and each first terminal having a first base portion, a first solder tail portion extending outwardly from one end of the first base portion for connection with a first printed circuit board, and a first spring contact portion bent upwardly from the other end of the first base portion and received in the mounting hole, and a plug, including a plug housing receiving a plurality of second terminals in two parallel arrays, said plug housing defining a longitudinal axis and a lateral axis, said longitudinal axis being orthogonal to said lateral axis, the plug housing having a bottom board, opposite sides of the bottom board forming a plurality of second slots for holding the second terminals, lateral boards extending upwardly from a rim of the bottom board to define a recess therein, each said lateral board having a plurality of engaging holes being formed therethrough, each said engaging hole extending in a direction substantially parallel to said lateral axis of said plug housing, each said engaging hole being formed in an upper portion of a respective one of said lateral boards, a plurality of lodged holes extending through the lateral boards in accordance with the second slots, and each second terminal having a second base portion, a second solder tail portion extending outwardly from one end of the second base portion for connection with a second printed circuit board, a second spring contact portion bent upwardly from the other end of the second base portion fitted in the lodged hole, each said second spring contact portion having a contact head formed on a free end thereof for releasable engagement with a respective one of said engaging holes, each said engaging hole being in communication with a respective one of said second slots and a respective one of said lodged holes, and a projection forming on the second spring contact portion and extending away from the second base portion, wherein the lateral boards slide into the lodged channel, the projected portion inserts into the recess, the first spring contact portion fastens the projection when the receptacle and the plug are in assembled condition.

2. The board-to-board connector as claimed in claim 1, wherein the first spring contact portion of the first terminal is bent to form a contact end which a bend angle is less than 90 degree.

3. The board-to-board connector as claimed in claim 1, wherein the projection is shaped with an arc surface.

4. The board-to-board connector as claimed in claim 1, wherein the receptacle includes plurality of a flange members formed on inner surfaces of the side walls extending toward the lodged channel, the plug is shaped to have a first wedge hole formed on outer surfaces of the lateral boards to engage said flange members, when the plug engages with the receptacle, the flange members interlocks with the first wedge hole.

5. The board-to-board connector as claimed in claim 1, wherein a retention portion extends upwardly from the first base portion of the first terminal.

6. The board-to-board connector as claimed in claim 5, wherein the side walls define a plurality of receiving holes to receive the retention portion of the first terminal.

7. The board-to-board connector as claimed in claim 5, wherein a pair of barbs are provided on opposite edges of the retention portion of the first terminal.

8. The board-to-board connector as claimed in claim 5, wherein the retention portion of the first terminal is provided with a locking portion extending parallel with the first base portion toward the first spring contact terminal, the lateral boards of the plug form a plurality of second wedge holes on its outer surface, when the plug engages with the receptacle, the locking portion interlocks the second wedge hole.

* * * * *